US009975736B2

(12) United States Patent
Anttila

(10) Patent No.: US 9,975,736 B2
(45) Date of Patent: May 22, 2018

(54) DOOR SILL UNIT AND METHOD FOR AN ELEVATOR LANDING DOOR UNIT

(71) Applicant: KONE Corporation, Helsinki (FI)

(72) Inventor: Harri Anttila, Jokela (FI)

(73) Assignee: KONE CORPORATION, Helsinki (FI)

( * ) Notice: Subject to any disclaimer, the term of this patent is extended or adjusted under 35 U.S.C. 154(b) by 0 days. days.

(21) Appl. No.: 14/191,056

(22) Filed: Feb. 26, 2014

(65) Prior Publication Data

US 2014/0251735 A1 Sep. 11, 2014

(30) Foreign Application Priority Data

Mar. 8, 2013 (EP) ..... 13158386

(51) Int. Cl.
*B66B 13/30* (2006.01)
*B66B 19/00* (2006.01)
*B66B 9/00* (2006.01)

(52) U.S. Cl.
CPC ..... *B66B 13/301* (2013.01); *B66B 9/00* (2013.01); *B66B 19/00* (2013.01); *Y10T 29/49623* (2015.01)

(58) Field of Classification Search
CPC ..... B66B 13/30; B66B 13/301; B66B 13/303
See application file for complete search history.

(56) References Cited

U.S. PATENT DOCUMENTS

| | | | | |
|---|---|---|---|---|
| 1,763,858 | A * | 6/1930 | Peelle | 187/400 |
| 1,995,858 | A * | 3/1935 | Mearns, Jr. | 49/410 |
| 2,089,380 | A * | 8/1937 | Kammerer | 49/468 |
| 2,188,049 | A * | 1/1940 | Kammerer | E06B 1/70 49/373 |
| 3,686,808 | A * | 8/1972 | Loomis | 52/211 |
| 6,108,926 | A * | 8/2000 | Fraser | B44D 3/38 33/758 |
| 6,202,798 | B1 * | 3/2001 | Friedman et al. | 187/333 |
| 6,247,559 | B1 | 6/2001 | Ach | |
| 6,938,380 | B2 * | 9/2005 | Friedman et al. | 52/30 |
| 7,621,379 | B2 * | 11/2009 | Miller et al. | 187/400 |
| 7,677,364 | B2 * | 3/2010 | Begle | 187/391 |
| 7,788,854 | B2 * | 9/2010 | Friedman et al. | 52/30 |
| 8,272,481 | B2 * | 9/2012 | Tracey et al. | 187/333 |
| 8,567,128 | B2 * | 10/2013 | Van Camp | E06B 1/70 49/468 |
| 2006/0054419 | A1 | 3/2006 | Friedman et al. | |
| 2009/0301821 | A1 * | 12/2009 | Fujiki et al. | 187/400 |

FOREIGN PATENT DOCUMENTS

| | | |
|---|---|---|
| JP | 03-223084 A | 10/1991 |
| JP | 06-191779 A | 7/1994 |

* cited by examiner

*Primary Examiner* — Jerry E Redman
*Assistant Examiner* — Catherine A Kelly
(74) *Attorney, Agent, or Firm* — Birch, Stewart, Kolasch & Birch, LLP

(57) ABSTRACT

The door sill unit includes a bottom support, a support construction extending upwards from the bottom support and a support member being supported by a pivot on the support construction so that the support member can be rotated around the pivot between a first position and a second position.

8 Claims, 5 Drawing Sheets

DOOR SILL UNIT AND METHOD FOR AN ELEVATOR LANDING DOOR UNIT

FIELD OF THE INVENTION

The invention relates to a door sill unit for an elevator landing door unit.

The invention also relates to an arrangement in an elevator.

The invention also relates to a method for installing an elevator landing door unit.

An elevator comprises an elevator car moving in a first direction upwards and downwards in an elevator shaft. The elevator car transports people and/or goods between the landings in a building. The elevator car can thus be stopped at each landing in the building in order for people and or goods to be loaded and/or unloaded to and from the elevator car. There is an elevator landing door unit in each landing in the opening between the landing and the shaft. The elevator landing door unit comprises a frame and at least one door panel. The at least one door panel provides a passage between the landing and the car.

BACKGROUND ART

Elevator landing door units have traditionally been installed from the elevator shaft. This means that the lifting machinery and the car platform must be installed in the elevator shaft before the elevator landing door units can be installed. The installation has traditionally been done so that a mechanic has first loaded an elevator landing door unit and other necessary equipment on the car platform. The mechanic has then driven with the car platform to the opening at the landing where the elevator landing door unit is to be installed. The mechanic has then begun the mounting of the elevator landing door unit from the car platform in the elevator shaft. He has first attached the sill at the inner wall of the elevator shaft at the lower level of the opening. Then the installation of the elevator landing door unit has proceeded step by step until the installation has been finished. After finishing the installation the mechanic has again driven with the car platform in order to fetch a new elevator landing door unit and so on.

The constructor of the building has not been able to finalize the entrance at the landings until the elevator landing door units have been installed. The finalizing of the entrance at the landings has had to be scheduled to be done after the elevator landing door units have been installed. The result of this has been that the finalizing of the entrance at the floors has had to be done at a rather late stage and depending fully of the time table of the elevator installation.

There is thus a need to be able to do the installation of the elevator landing door units at an earlier stage in order to avoid the above mentioned problems.

BRIEF DESCRIPTION OF THE INVENTION

An object of the present invention is to solve the problems associated with prior art elevator landing door installations. The solution to the problems is to use a door sill unit and to make the installation of the elevator landing door units from the landings instead of from the elevator shaft.

The door sill unit for an elevator landing door unit comprises a bottom support, a support construction extending upwards from the bottom support and a support member being supported with a pivot on the support construction so that the support member is rotatable around the pivot between a first position and a second position.

The door sill unit is a separate unit which can be positioned on the landing at the opening to the elevator shaft. A part of the door sill unit extends into the elevator shaft and the rest of the door sill unit remains on the landing. A temporary sill is attached to the support member of the door sill unit. The support member is rotated around the pivot to the second position so that a groove in the temporary sill opens into the landing. The elevator landing door unit is turned in a horizontal position and attached from the bottom of the frame to the support member so that guide means at the bottom of the at least one door panel of the elevator landing door unit sets into the groove in the temporary sill. The elevator landing door unit is then rotated into an upright position by rotating the support member around the pivot into the first position. The elevator landing door unit is then fastened from the frame at the side walls of the landing at the opening to the elevator shaft. The entrance at the landing can now be finalized by the builder.

The elevator landing door unit can thus be installed from the landing. There is no need to have the car platform and the lifting machinery ready in the elevator shaft before installing the elevator landing door unit. Even the elevator shaft could still be under construction when the landing door units are installed.

The elevator landing door unit is installed with a temporary sill, which is short enough to pass through the opening from the landing to the elevator shaft. The temporary sill can then later be changed to a permanent sill of full length from the elevator shaft when the lifting machinery and the car platform have been installed. Also the machinery needed to move the at least one door panel can be installed later from the car platform. This machinery is mounted on a railing and the railing can be fastened to the wall of the shaft above the elevator landing door unit. The railing also comprises a guide rail for the guide elements of the at least one door panel. The at least one door panel is thus supported with the guide elements rolling or gliding on the guide rail. There is a drive motor with related machinery installed on the car. A connection between the machinery moving the at least one door panel on the car and the machinery moving the at least one door panel in the elevator landing door unit is activated when the car stops at the landing. The at least one door panel in the elevator landing door unit and the at least one door panel in the car will thus be moved by the same motor situated in the car.

The fact that the permanent sill and the rail comprising the machinery are installed at a later stage from the elevator shaft is advantageous as there is much less dust in the air at that stage. Dust accumulated into the permanent sill and/or the rail comprising the machinery might cause problems in the operation of said equipment.

BRIEF DESCRIPTION OF THE DRAWINGS

The invention will in the following be described in greater detail by means of preferred embodiments with reference to the attached drawings, in which.

DETAILED DESCRIPTION OF EMBODIMENTS OF THE INVENTION

Figure 1:
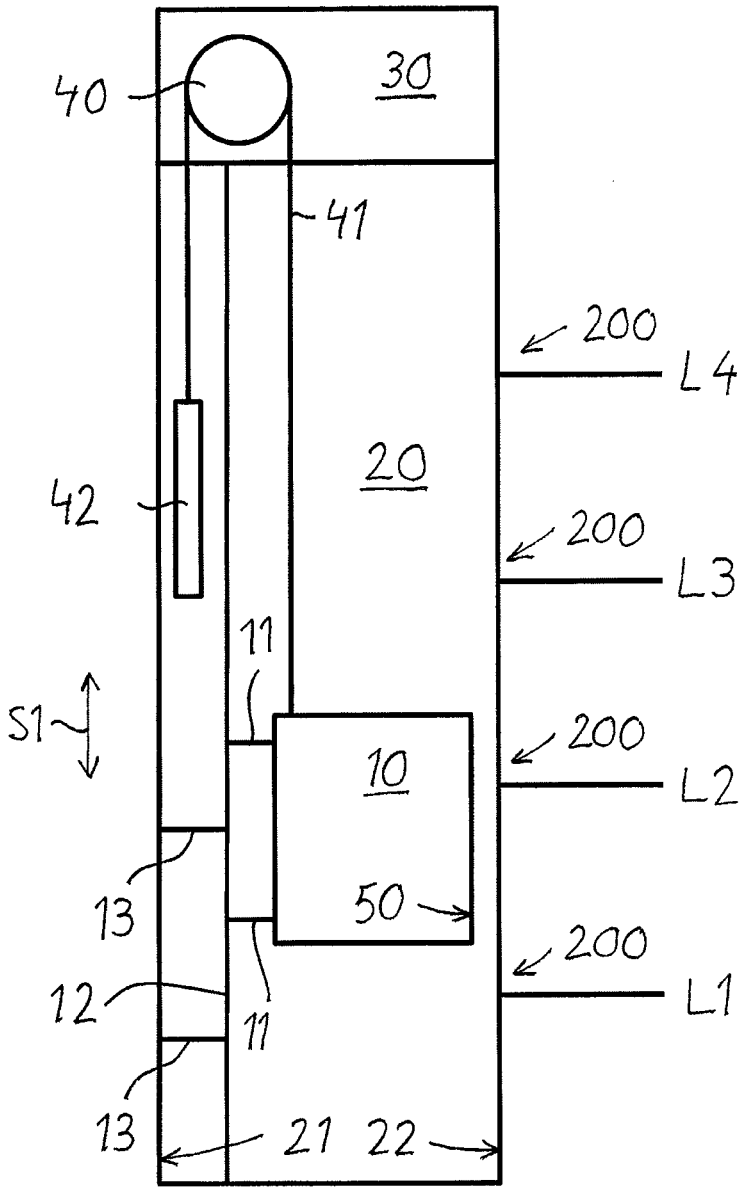
FIG. 1 shows a vertical cross section of an elevator.

FIG. 1 shows a vertical cross section of an elevator. The elevator comprises a car 10, an elevator shaft 20, a machine room 30, lifting machinery 40, ropes 41, and a counter weight 42. The lifting machinery 40 moves the car 10 in a first direction S1 upwards and downwards in the vertically extending elevator shaft 20. The car 10 is carried by the ropes 41, which connect the car 10 to the counter weight 42. The car 10 is further supported with guide elements 11 at guide rails 12 extending in the vertical direction in the shaft 20. The figure shows only one guide rail 12, but there can be several guide rails 12 on different sides of the car 10. The guide elements 11 can comprise rolls rolling on the guide rails 12 or glide elements gliding on the guide rails 12 when the car 10 is moving upwards and downwards. The guide rails 12 are supported with support means 13 at one of the side wall structures 21, 22 of the elevator shaft 20. The figure shows only two support means 13, but there are several support means 13 along the height of the guide rail 12. The rolls or glide elements 11 engaging with the guide rails 12 keep the car 10 in position in the horizontal plane when the car 10 moves upwards and downwards in the elevator shaft 20. The counter weight 42 is supported in a corresponding way on guide rails supported on the wall structure 21 of the shaft 20. The figure also shows the landings L1 to L4 and the landing door units 200. The car 10 can be stopper at each landing L1 to L4 so that the floor of the car 10 is at the same level as the floor of the landing L1 to L4. The elevator shaft 20 can be formed so that the wall structure 21, 22 is formed of solid walls or so that the wall structure 21, 22 is formed of an open steel structure.

The car 10 comprises a car door unit comprising at least one door panel opening and closing a passage from the car 10 to the landing L1 to L4.

Each landing L1 to L4 comprises a corresponding elevator landing door unit 200 comprising a frame and at least one door panel opening and closing a passage from the landing to the car 10.

The elevator landing door unit comprises normally two door panels sliding in the opposite direction in order to open or close the passage from the landing to the car. Both door panels could, however, also slide in the same direction in a case where there is only space at one side in the elevator shaft for the doors to move. In cases where the elevator shaft is so narrow that it is not possible to use two door panels four door panels i.e. two door panels at each side could be used. This would limit the space needed in the side direction in the elevator shaft. Naturally also only one door panel sliding in either direction would be possible to use when there is enough room for this in the side direction in the elevator shaft. It is naturally not necessary to use sliding door(s), but hinged door(s) could be used instead. The door arrangement in the car door unit is adapted to the door arrangement in the elevator landing door unit. The car door unit comprises thus a corresponding number of door panels moving in the same way and direction as the door elements in the elevator landing door unit. The motor moving the door panels is positioned in the car and the elevator landing door unit is arranged to be connected mechanically to the car door unit so that the door panels in both units move together driven by the same motor.

Figure 2:
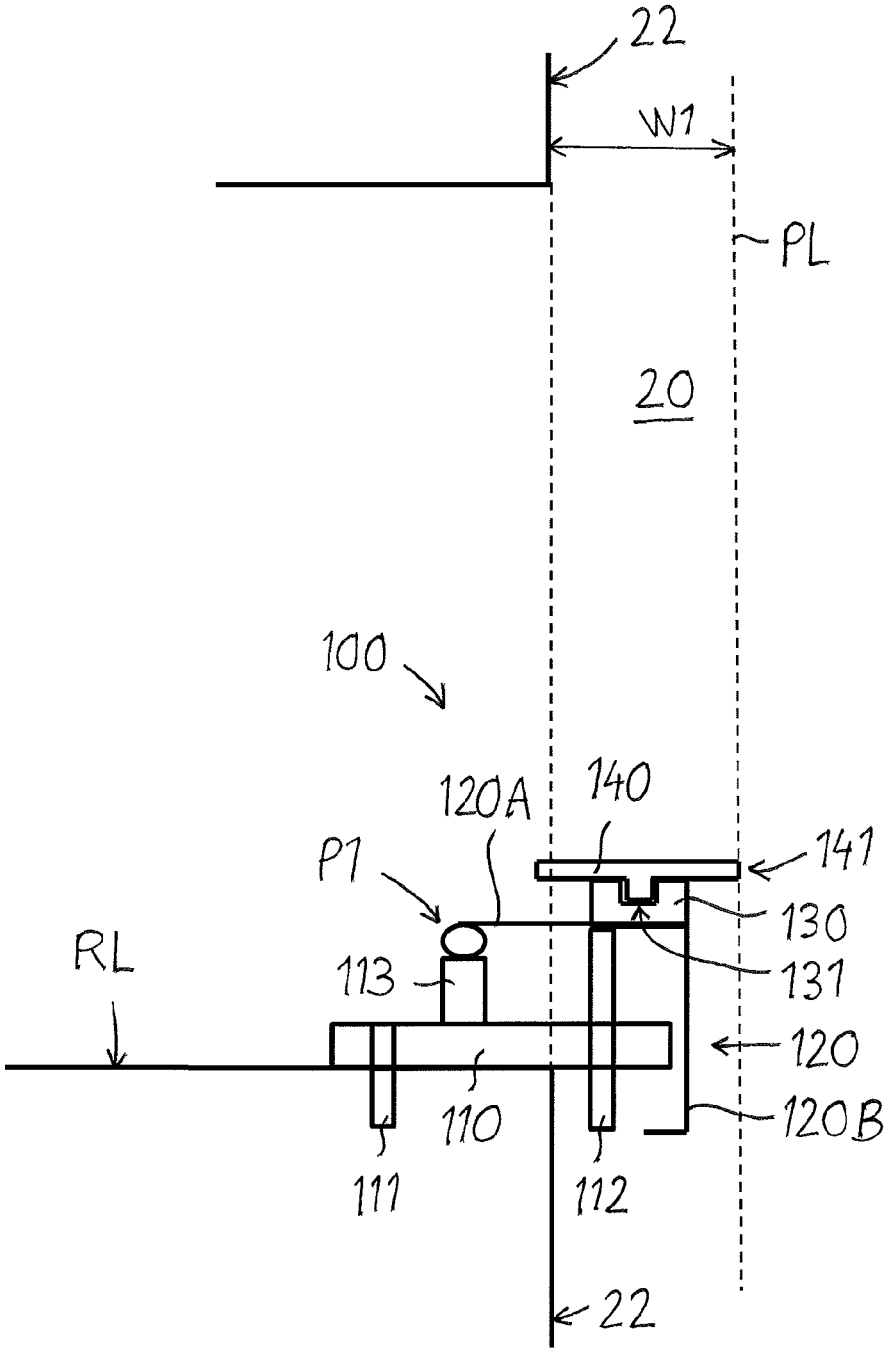
FIG. 2 shows a cross section of a door sill unit for an elevator landing door unit according to the invention.

FIG. 2 shows a cross section of a door sill unit for an elevator landing door unit according to the invention. The door sill unit 100 comprises a bottom support 110 fastened with fastening means 111 to the raw floor RL of the landing. The bottom support 110 extends partly into the shaft 20 and comprises regulating means 112 positioned within the shaft 20. The door sill unit 100 comprises further a support construction 113 extending vertically upwards from the bottom support 110. A support member 120 is attached with a pivot P1 on the support construction 113. The support member 120 can be rotated around the pivot P1 between a first position and a second position. The support member 120 rotates 90 degrees between the first position and the second position. A temporary sill 130 is further attached to the support member 120. The temporary sill 130 comprises a groove 131 receiving the guide means positioned at the bottom of the at least one door panel in the elevator landing door unit. There is further a measurement member 140 positioned in the groove 131 of the temporary sill 130 in order to help to determine the correct position in the horizontal direction of the door sill unit 100. The correct position of the door sill unit 100 in the horizontal direction is determined so that the edge 141 of the measurement member 140 is on the plum line PL extending vertically in the shaft 20. The plum line PL is at a predetermined horizontal distance W1 from the vertical wall structure 22 of the shaft 20. The correct height of the support member 120 and thus also the temporary sill 130 is determined with the regulating means 112. The regulating means 112 could be formed of a bolt and a nut in which case it is easy to screw the bolt so that the end of the bolt is at a desired height and then lock the bolt with the nut at the bottom support 110.

The bottom support 110 is in this embodiment formed of a rectangular metal plate. The support construction 113 is in this embodiment formed of a metal shaft. The support member 120 is in this embodiment formed of a metal sheet that is bent so that the two branches 120A, 120B of the sheet are perpendicular to each other. A first branch 120A forms a support surface and extends in a horizontal direction and a second branch extends in a vertical direction downwards when the support member 120 is in the first position. An outer edge of the first branch 120A is attached to the pivot P1. The temporary sill 130 is attached to the first branch 120A at the fold. The second branch 120B prevents visibility from the elevator shaft 20 into the door sill unit 100.

Figure 3:
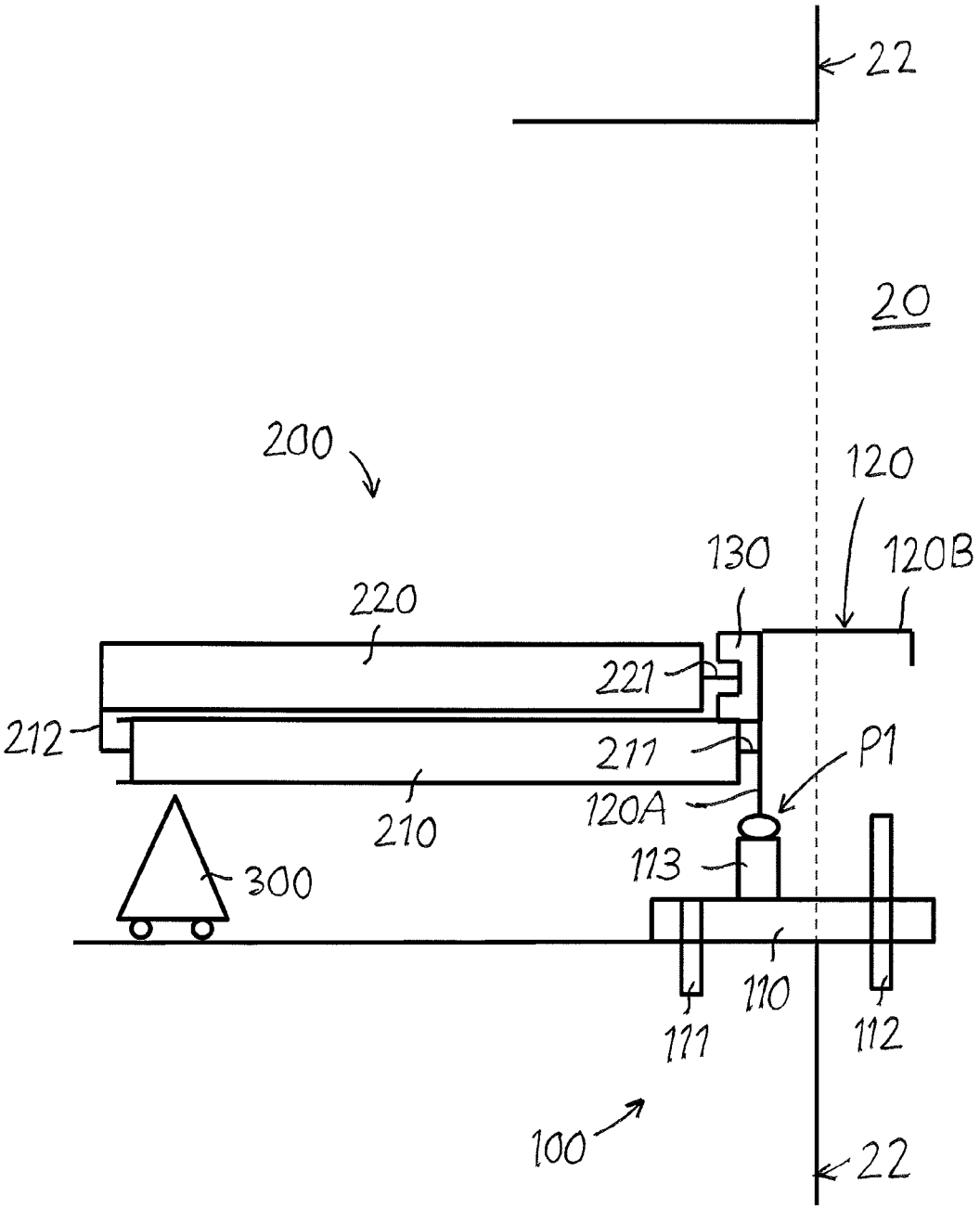
FIG. 3 shows a cross section of an elevator landing door unit attached to the door sill unit of FIG. 2.

FIG. 3 shows a cross section of an elevator landing door unit installed on the door sill unit of FIG. 2. The elevator landing door unit 200 comprises a frame 210 and at least one door panel 220, advantageously two door panels 220. There is a fire labyrinth 212 supporting the at least one door panel 220 at the frame 210. The function of the fire labyrinth 212 in normal operation is to prevent the at least one door panel 220 from falling into the elevator shaft 20 in case the supporting machinery that supports the at least one door panel 220 breaks down. The support member 120 of the door sill unit 100 has been rotated around the pivot P1 in order to have the temporary sill 130 in a position where the groove 131 opens into the landing. The measurement member 140 has been removed from the temporary sill 130. The elevator landing door unit 200 is now pushed against the support member 120 so that guide means 221 at the bottom of the at least one door panel 220 set into the groove 131 in the temporary sill 130. The frame 210 sets against the support member 120 and is supported from the bottom with fastening means 211 at the support member 120. The outer end of the elevator landing door unit 200 can be supported by a suitable support device 300 during this phase of the installation. The fastening means 211 at the bottom of the frame 210 could be formed of a snap joint in which case there would be a corresponding snap joint on the support member 120. Snap joints would make the installation faster, but naturally also other fastening means such as bolts and nuts could be used.

Figure 4:
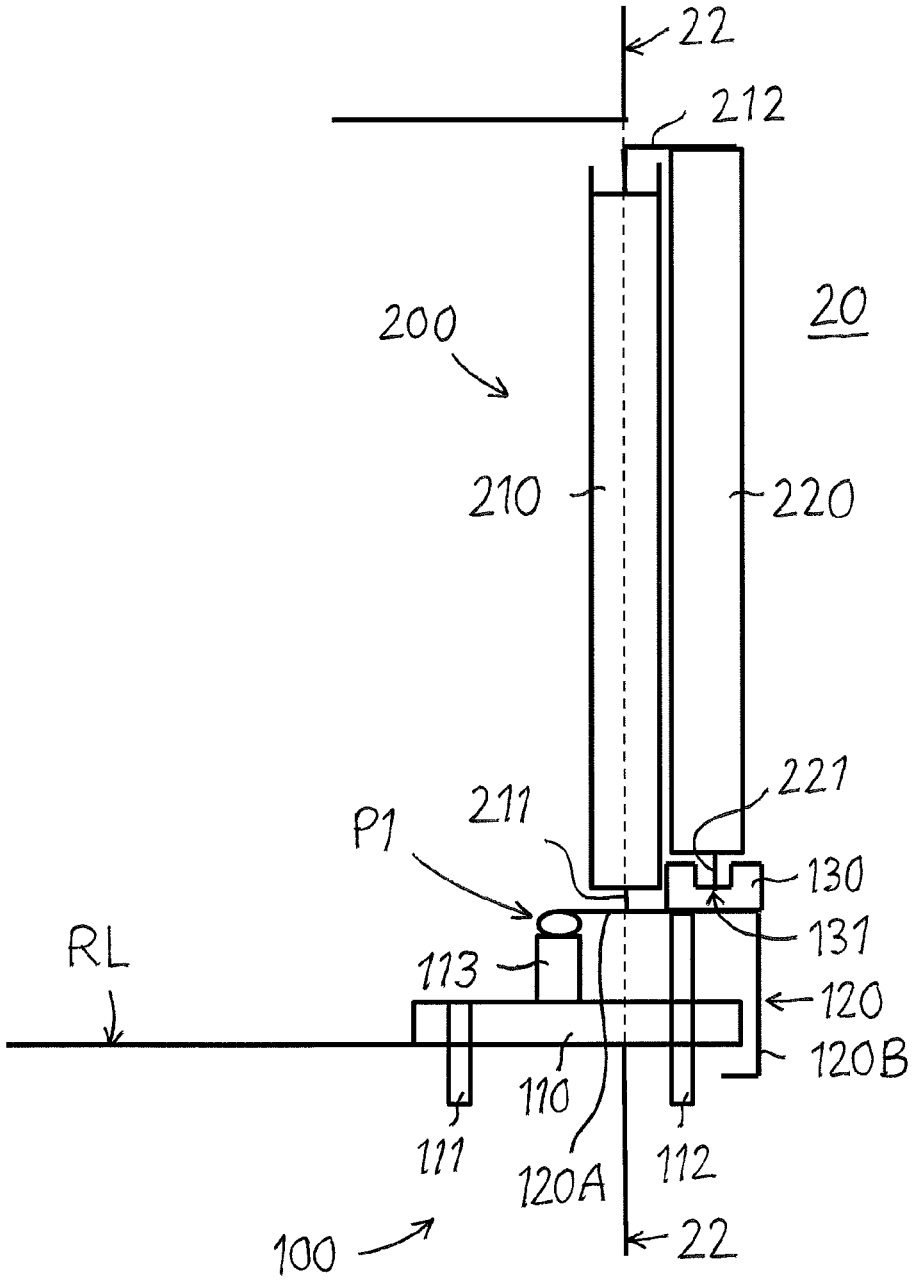
FIG. 4 shows a cross section at the line of FIG. 5 of the elevator landing door unit of FIG. 3 in an upright position

FIG. 4 shows a cross section of the elevator landing door unit of FIG. 3 in an upright position. The elevator landing door unit 200 has now been lifted into an upright position by rotating the elevator landing door unit 200 and the support member 120 in the door sill unit 100 around the pivot P1. The elevator landing door unit 200 is now ready to be fastened to the side walls on the landing.

Figure 5:
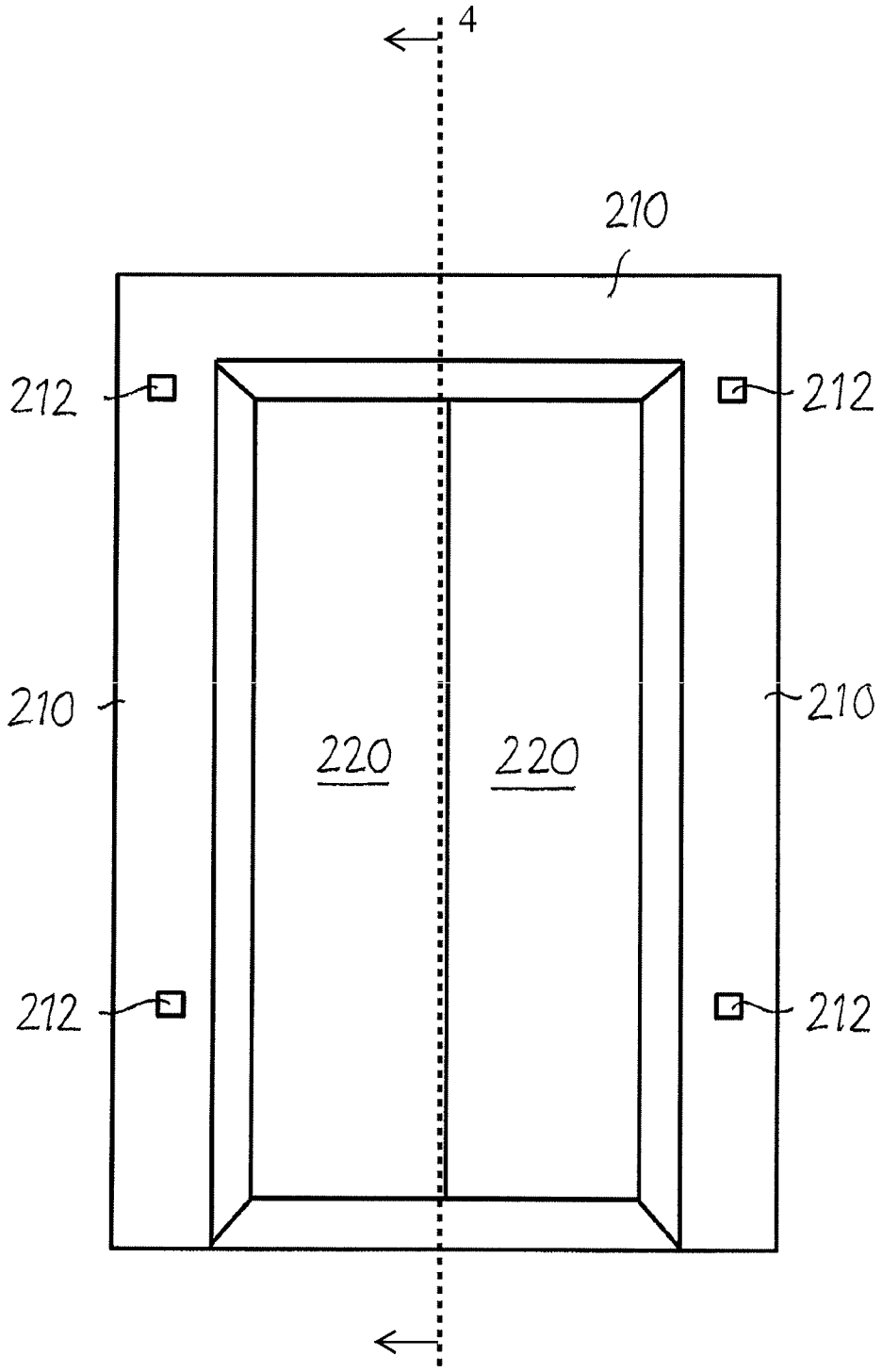
FIG. 5 shows a front view of the elevator landing door unit of FIG. 4.

FIG. 5 shows a front view of the elevator landing door unit 200 according to FIG. 4. The frame 210 is attached with suitable fastening means 212 e.g. side fixing brackets to the side walls on the landing at the opening to the elevator shaft 20. The entrance at the landing can now be finished by the builder. The builder will make a mortar pouring on the floors of the landings so that the final floor level will rise to a level above the pivot P1 and below the upper edge of the temporary sill 130. Most of the door sill unit 100 will thus be buried into the mortar pouring.

The final installation of the elevator landing door unit 200 can be done later from the elevator shaft 20 when the lifting machinery 40 and the car platform 10 has been installed into the elevator shaft 20. The temporary sill 130 of the elevator landing unit 200 can be changed to a permanent sill. The permanent sill is longer than the temporary sill 130 and can be attached to the wall structure 22 of the elevator shaft 20 at the lower end of the elevator landing door unit 200. The longer permanent sill is needed in order to make the opening of the door panels 220 possible. The railing comprising the rail and the hanger plate as well as the necessary machinery for supporting and moving the door panels 220 in the elevator landing door unit 200 can also be installed at this later stage from the shaft 20. The railing can be attached to the wall structure 22 of the elevator shaft 20.

The use of the elevator landing door unit according to the invention is not limited to the elevator shown in FIG. 1. The elevator landing door unit can be used in any elevator e.g. in elevators having a machine room and a counter weight as well as in elevators where there is no machine room and/or no counter weight. The wall structure 21, 22 in the shaft 20 can be e.g. a steel construction or a solid wall.

The door sill unit 100 as well as the elevator landing door unit 200 extends in the lateral direction substantially over the total lateral width of the opening between the landing L1 to L4 and the shaft 20.

The bottom support 110 could instead of a metal plate be formed e.g. of metal beams attached to each other to form a support surface. The support construction 113 could instead of a metal shaft be formed of several inclined metal beams forming a support for the swivel P1. The swivel P1 could be arranged with a shaft so that the support member 120 rotates around the shaft.

The use of the invention is naturally not limited to the type of elevator disclosed in FIG. 1, but the invention can be used in any type of elevator e.g. also in elevators lacking a machine room and/or a counterweight.

It will be obvious to a person skilled in the art that, as the technology advances, the inventive concept can be implemented in various ways. The invention and its embodiments are not limited to the examples described above but may vary within the scope of the claims.

The invention claimed is:

1. A door sill unit for an elevator landing door unit, the door sill unit comprising:

a bottom support extending into an elevator shaft and comprising a regulator positioned within the elevator shaft;

a support construction extending upwards from the bottom support;

a support member being supported with a pivot on the support construction so that the support member is rotatable around the pivot between a first position and a second position, the entire pivot being disposed above the bottom support; and a temporary sill;

wherein the support member is made of a sheet that is bent so that a first branch and a second branch of the sheet are perpendicular to each other, wherein the first branch is attached to the pivot, wherein in the first position, the first branch extends in a vertical direction and the second branch extends in a horizontal direction, and wherein in the second position, the first branch forms a support surface and extends in the horizontal direction into the elevator shaft, the second branch is located entirely within the elevator shaft and extends vertically downwardly below a floor of a landing, and the temporary sill is attached to the first branch of the support member and is configured to be attached to a guide of a door panel.

2. The door sill unit according to claim 1, wherein the regulator comprises at least one bolt attached to the bottom support, an upper end of the at least one bolt attached to the support member, and the height of the support member being regulated by raising or lowering the at least one bolt in relation to the bottom support.

3. The door sill unit according to claim 1, wherein the door sill unit further comprises a fastener configured to fasten the door sill unit from the bottom support to a floor of the landing.

4. An arrangement in an elevator, said elevator comprising a car, a lifting machinery and a shaft, said lifting machinery moving the car in a first direction upwards and downwards in the vertically extending shaft between landings in a building, each landing being provided with an elevator landing door unit positioned in the opening between the landing and the shaft, said elevator landing door unit comprising a frame and at least one door panel, said at least one door panel opening and closing a passage between the landing and the car in order for passengers or goods to enter the car or leave the car at the landing, wherein the arrangement further comprises the door sill unit according to claim 1 for supporting the elevator landing door unit.

5. The door sill unit according to claim 2, wherein the door sill unit further comprises a fastener configured to fasten the door sill unit from the bottom support to a floor of the landing.

6. The door sill unit according to claim 1, wherein in the second position, a measurement member is positioned in a groove of the temporary sill, and an edge of the measurement member extends to a vertically extending plum line provided in the elevator shaft and the measurement member is configured to determine the correct position of the door sill unit with respect to a landing.

7. The door sill unit according to claim 1, wherein in the first position, the bottom support is located within an interior portion of the support member.

8. A method for installing an elevator landing door unit comprising a frame and at least one door panel into an opening between a landing and an elevator shaft, said method comprising the steps of:

attaching a door sill unit at a landing at the opening between the landing and the elevator shaft, said door sill unit comprising a bottom support extending into the elevator shaft and comprising a regulator positioned within the elevator shaft, a support construction extending upwards from the bottom support and a support member supported with a pivot on the support construction so that the support member can be rotated around the pivot between a first position and a second position, wherein the support member is made of a sheet that is bent so that a first branch and a second branch of the sheet are perpendicular to each other, wherein the first branch is attached to the pivot, wherein in the first position, the first branch extends in a vertical direction and the second branch extends in a horizontal direction, and wherein in the second position, the first branch forms a support surface and extends in the horizontal direction into the elevator shaft, the second branch is located entirely within the elevator shaft and extends vertically downwardly below a floor of a landing, attaching a temporary sill on the support member and rotating the support member around the pivot into the second position so that a groove in the temporary sill opens horizontally to the landing, positioning the elevator landing door unit in a horizontal position and attaching the elevator landing door unit from a bottom of the frame to the support member so that guide means at a bottom of the at least one door panel sets into the groove in the temporary sill, rotating the elevator landing door unit with the support member around the pivot into the first position so that the elevator landing door unit is in a vertical position, and attaching the elevator landing door unit from the frame to the walls of the landing.

* * * * *